United States Patent [19]

Cemenska et al.

[11] 4,187,807

[45] Feb. 12, 1980

[54] COOLED ENGINE VALVE WITH IMPROVED HEAT TRANSFER

[75] Inventors: Richard A. Cemenska, Edelstein; Alexander Goloff, East Peoria, both of Ill.

[73] Assignee: Caterpillar Tractor Co., Peoria, Ill.

[21] Appl. No.: 879,843

[22] Filed: Feb. 22, 1978

[51] Int. Cl.[2] ..... F01P 3/14

[52] U.S. Cl. ..... 123/41.34; 123/41.41; 123/188 AA; 123/188 GC; 137/340; 123/188 A

[58] Field of Search ..... 123/41.16, 41.17, 41.31, 123/41.34, 41.41, 188 A, 188 AA, 188 GC; 137/340

[56] References Cited

U.S. PATENT DOCUMENTS

| | | | |
|---|---|---|---|
| 698,474 | 4/1902 | Ebbs | 123/41.41 |
| 1,914,340 | 6/1933 | Holzwarth | 123/41.41 |
| 2,017,294 | 10/1935 | Rich | 123/41.41 |
| 2,188,248 | 1/1940 | Possenti | 123/41.16 |
| 2,403,001 | 7/1946 | Jacobi | 123/188 AA |
| 3,871,339 | 3/1975 | Kuhn | 123/188 AA |
| 3,945,356 | 3/1976 | Kuhn | 123/41.41 |

FOREIGN PATENT DOCUMENTS

| | | | |
|---|---|---|---|
| 716820 | 12/1931 | France | 123/188 GC |
| 440206 | 12/1935 | United Kingdom | 123/188 A |
| 665176 | 1/1952 | United Kingdom | 123/41.16 |

*Primary Examiner*—Charles J. Myhre
*Assistant Examiner*—Jeffrey L. Yates
*Attorney, Agent, or Firm*—Phillips, Moore, Weissenberger, Lempio & Majestic

[57] ABSTRACT

An engine valve comprises an elongated stem having a head secured on an end thereof. A tube is disposed in the stem to terminate at an outlet to communicate a liquid coolant, such as oil, to an annular chamber defined in the head. An agitator ring is loosely mounted in the chamber for moving therein during valve operation. A plurality of circumferentially disposed and radially extending ribs are preferably secured between the head and a cap secured thereon to define a plurality of inlet and outlet passageways therebetween.

18 Claims, 3 Drawing Figures

COOLED ENGINE VALVE WITH IMPROVED HEAT TRANSFER

BACKGROUND OF THE INVENTION

This invention relates to means for cooling a valve adapted for use in an internal combustion engine.

Diesel engines, operating on high sulfur fuels, oftentimes contain vanadium compounds which require periodic "top end overhauls" or grinding of the exhaust valves due to corrosion effects and high heat levels imposed on the faces of the valves. Such corrosion tends to induce a "channelling" or "guttering" of the valve faces to accelerate such corrosion, thus giving rise to gas leakage past the valves and potential breakage of the valve heads. The corrosion effects also occur on the top of the valve heads which tends to induce severe pitting, also leading to valve head failures.

Metallurgical solutions have not fully solved the corrosion problem due to the high temperature levels experienced by the valve during operation thereof. Therefore, the state of the art has made various attempts to cool an exhaust valve by packing it with metallic sodium or other suitable cooling medium or by circulating oil through the valve. The former attempt, although exhibiting a desirable "cocktail shaker" action, has a tendency to raise the temperature level of the valve stem to thus reduce the service life of the tubular guide reciprocally mounting the valve in an engine. In particular, heat transfer necessary occurs by conduction through the valve stem, an oil film within the guide, the guide proper and the cylinder head boss surrounding the guide. As a consequence, the cooling medium contained in the valve will heat-up to an undesirable level to prevent efficient cooling of the valve face.

Also, circulation of oil through the valve for cooling purposes has not provided a final solution to the corrosion problem. In particular, a conventional valve arrangement of this type is primarily dependent on the principal of forced convection for cooling purposes, such as by the pumping of oil through a fill pipe and/or cavity. Thus, the cooling oil communicated to the head of the valve is not subjected to a desirable "cocktail shaker" action which would tend to provide for efficient distribution and flow of the cooling oil to the critical surface areas of the valve.

In addition, conventional multi-part valves of this type exhibit structural deficiencies which do not adequately counteract shear and bending stresses imposed on critical areas of the valve during operation thereof.

SUMMARY OF THE INVENTION

The present invention is directed to overcoming one or more of the problems as set forth above.

The improved valve of this invention comprises an elongated stem having a head disposed at an end thereof with the head defining an annular valve face thereon. The valve is provided with circulating means for circulating a coolant through the valve, including an inlet, an outlet and annular chamber means defined in the head for communicating the coolant from the inlet to the outlet. Agitating means, disposed in the chamber means, will agitate the coolant during valve operation for improving heat transfer from the valve face to the coolant.

Another novel aspect of this invention resides in the construction and arrangement of the head of the valve for substantially increasing the structural integrity thereof to counteract bending and shear stresses imposed on the valve during its operation. In particular, a cap is secured to the head of the valve and a plurality of circumferentially spaced and radially extending reinforcing ribs are secured between the head and the cap to alternately define a plurality of inlet and outlet passageways between the ribs. The cap is secured to the head by an annular weld and a plurality of circumferentially disposed welds secure the ribs to the cap with inner ends of each pair of circumferentially adjacent pair of ribs being secured together by a bridging portion.

BRIEF DESCRIPTION OF THE DRAWING

Other objects of this invention will become apparent from the following description and accompanying drawing wherein.

DETAILED DESCRIPTION OF THE PREFERRED EMBODIMENT

Figure 1:
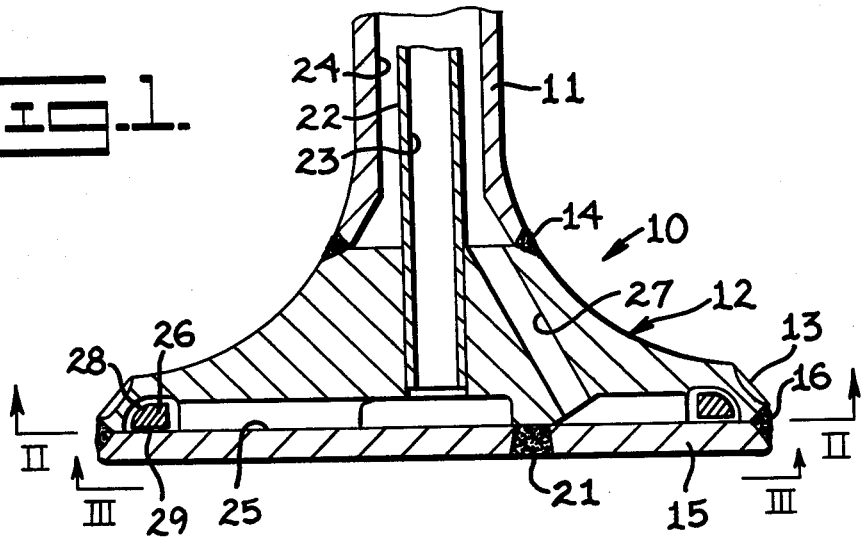
FIG. 1 is a longitudinal sectional view of an engine valve embodying this invention.

FIG. 1 illustrates an engine valve 10 comprising partially illustrated hollow stem 11 having a head 12 secured to a lower end thereof. The head has an annular valve face 13 formed thereon adapted to engage a like-formed seat defined on the cylinder head of an internal combustion engine. Although the valve is particularly adapted for use as an exhaust valve, since corrosion and heat problems are of particular concern therewith, it should be understood that the inlet valves for an engine could be constructed in a like manner. The stem may be formed on a steel tube having its lower end secured to head 12 by an annular weld 14. The head may comprise a steel forging exhibiting high strength and anti-corrosion characteristics. Alternatively, the stem and head may be cast as a unitary structure and machined to specifications.

Figure 2:
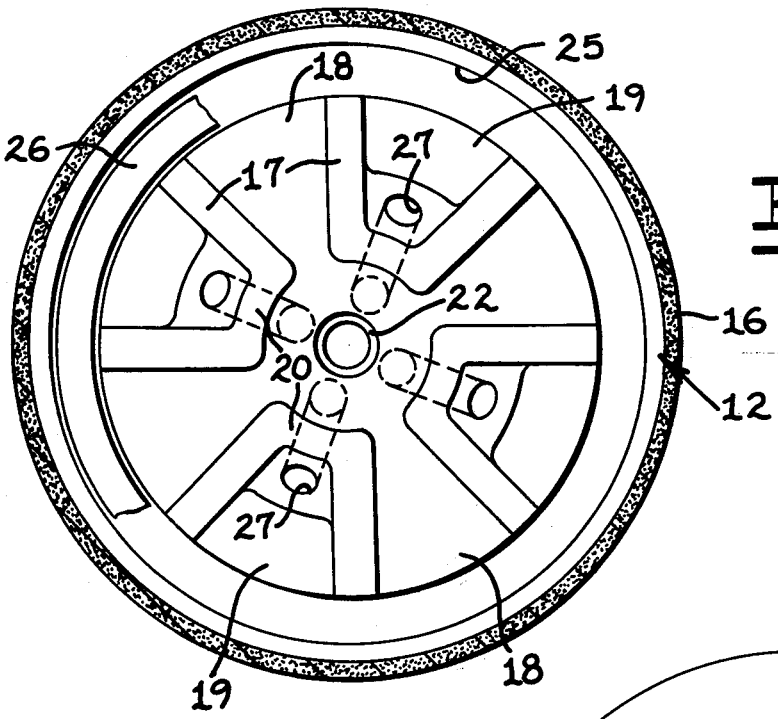
FIG. 2 is a transverse sectional view through a head of the valve, taken in the direction of arrows II—II in FIG. 1.
Figure 3:
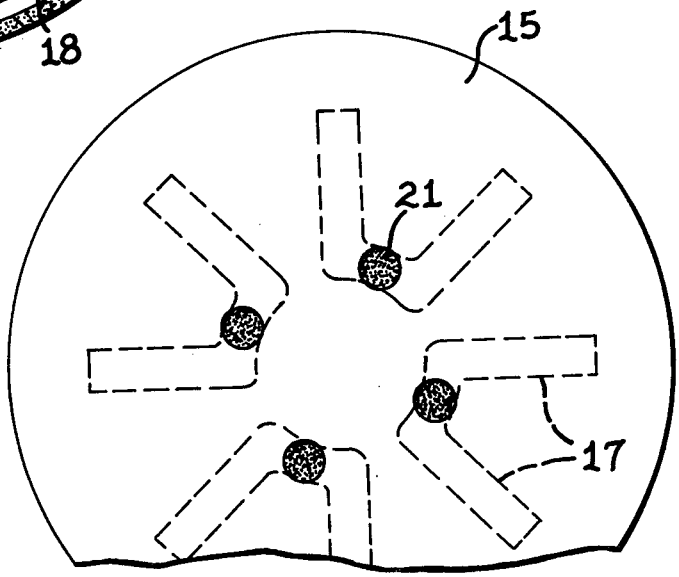
FIG. 3 is a partial bottom plan view of the valve to illustrate a plurality of plug welds secured thereon.

An annular cap 15 is secured to head 12 by an annular weld 16. As more clearly illustrated in FIG. 2, a plurality of circumferentially disposed and radially extending ribs 17 are formed integrally on an underside of head 12 to alternately define a plurality of inlet and outlet passageways 18 and 19, respectively, therebetween. Each pair of circumferentially adjacent ribs are secured together by a bridging portion 20, secured to cap 15 by a plug weld 21 extending through the cap (FIGS. 1 and 3).

One novel feature of this invention comprises the centered relationship of the plug welds between the cap and valve head, and radially inwardly from weld 16, to prevent fretting in the area of the valve, adjacent to ribs 17. In addition, this arrangement functions to secure the cap and valve head together to counteract shear loads imposed on the valve during operation thereof. Thus, the valve will exhibit a substantial section modulus to thereby counteract shear loads and stresses imposed on the valve during operation thereof.

A circulating means defined in the valve for circulating a coolant, such as oil, from an inlet to an outlet thereof will now be described. Such circulating means comprises a steel tube 22 disposed centrally in stem 11 and having its lower end suitably secured centrally within head 12 and defining a first or inlet passage 23 therein, communicating with inlet passageways 18. A second or outlet passage 24 is defined between the tube and stem 11 to communicate with a lube system at its upper end in a conventional manner. Although passages 23 and 24 preferably comprise inlet and outlet passages, respectively, it should be understood that coolant flow could be reversed therethrough, as is well known in the art.

Inlet passage 23 communicates with inlet passageways 18 to disperse oil radially outwardly into annular chamber 25. The chamber, having an agitating means or ring 26 loosely mounted therein, further communicates with outlet passageways 19 which, in turn, communicate with outlet passage 24 via a plurality of circumferentially disposed outlet ports 27, defined by drilled holes formed through head 12. It should be understood that although eight ribs 17 are illustrated to define four inlet passageways 18 and four outlet passageways 19 that any desired number thereof could be employed for a particular valve application. However, it is desirable to maintain an even number of ribs so that coolant flow is more easily balanced around the valve head.

Another novel feature of this invention comprises the utilization of agitator ring 26 for aiding in the cooling of the valve during operation thereof. In this connection, it should be noted that oil is generally considered to constitute a fairly poor coolant, unless it is vigorously agitated. The upper surface of the agitator ring, when viewed in cross-section in FIG. 1, preferably defines an arcuate surface 28 which closely conforms to the arcuate configuration of the adjacent wall portions of head 12, partially defining chamber 25.

Thus, when the ring moves up and down within the chamber during reciprocation of the valve, heated oil will be forced out of the chamber several times a second to provide a "cocktail shaker" action whereby oil is continuously and uniformly agitated to improve heat transfer from valve face 13 to the coolant. It should be further noted that the upper side of cap 15 is preferably flat to thus conform to a flat bottom surface 29 of the agitator ring. The closely fitted and conformed areas thus provided by surfaces 28 and 29 of the agitator ring within chamber 25 further provide that such surfaces are not prone to deformation which could result in fatigue failure of the ring.

Furthermore, the stagnant boundary layer of oil which is squeezed out about the entire perimeter of the valve head provides for uniform cooling since the oil film coefficient is both relatively high and uniform. It should be further noted that contact stresses, even upon impact of the agitator ring with valve head 12 and cap 15, are minimized due to the relatively large surface area contacts provided therebetween and because a very thin oil film is normally maintained between the adjacent surfaces to prevent metal-to-metal contact and wear, but does not interfere significantly with the desired heat transfer. The thin film of oil is only a minor barrier to the desired heat transfer from the critical heated areas of the valve, adjacent to valve face 13, to the oil in chamber 25.

In comparison, a conventional oil-cooled valve normally provides laminar oil flow through the passages thereof, since the passages are either unduly restricted or the oil moves very slowly in portions of the passages. In contrast thereto, the free-flowing passages and passageways comprising the coolant circulating means for valve 10 cooperate with the "cocktail shaker" action of agitator ring 26 to provide improved cooling. The agitator ring vigorously agitates the oil into a highly turbulent state to aid in such cooling, adjacent to valve face 13, which is a critical portion of the valve to be cooled.

In summary of the valve cooling operation, relatively cool oil is communicated to chamber 25 via inlet passage 23 and inlet passageways 18. Up and down movement of agitator ring 26 will function to agitate heated oil in the chamber, such oil being heated by heat transfer from the valve in the critical areas adjacent to valve face 13. The oil then communicates with outlet passage 24 via outlet passageways 19 and ports 27 and is returned to the sump for recirculation purposes. It should be noted that downward movement of the ring permits relatively cool oil to fill the portion of chamber 25, above the ring. In addition, ribs 17 function to aid in dissipating heat to the oil for valve cooling purposes.

The embodiments of the invention in which an exclusive property or privilege is claimed are defined as follows:

1. A valve comprising
an elongated stem,
a head disposed at an end of said stem and defining an annular valve face thereon
circulating means in said valve for circulating a coolant therethrough, including an inlet passage, an outlet passage and annular chamber means defined in said head to communicate with said inlet and outlet passages and disposed closely adjacent to said valve face, and
agitating means disposed in said chamber means for vibrating therein during valve operation for forcing oil back and forth in said chamber means for improving heat transfer from said valve face to said coolant.

2. The valve of claim 1 wherein said agitating means comprises an annular ring loosely mounted for vertical movements in said chamber means.

3. The valve of claim 2 wherein said ring, when viewed in cross-section, has an arcuate upper surface defined thereon and wherein an upper side of said chamber means, defined in said head, is arcuate and at least substantially conforms to the arcuate upper surface of said ring.

4. The valve of claim 3 further comprising a cap secured on an end of said head to define said chamber means therewith and wherein a lower surface of said ring, when viewed in cross-section, is flat and at least substantially conforms to a flat upper surface of said cap.

5. The valve of claim 2 wherein said ring is disposed in close proximity to said valve face.

6. The valve of claim 1 further comprising a tube disposed centrally in said stem and having a lower end thereof secured to said head and wherein said inlet passage is defined in said tube and wherein said outlet passage is defined between said tube and said stem.

7. The valve of claim 1 wherein said circulating means further comprises a plurality of circumferentially disposed and radially extending inlet passageways defined in said head to communicate said inlet passage with said chamber means and a plurality of circumferentially disposed and radially extending outlet passageways defined in said head to communicate said chamber means with said outlet passage.

8. The valve of claim 7 wherein said circulating means further comprises an elongated port formed through said head to communicate each of said outlet passageways with said outlet passage.

9. The valve of claim 7 wherein said inlet and outlet passageways are defined by a plurality of circumferentially disposed and radially extending ribs secured to said head.

10. The valve of claim 9 further comprising an annular cap mounted on an end of said head and secured to said ribs and further secured to the periphery of said head.

11. The valve of claim 10 further comprising a bridging portion secured between each pair of circumferentially adjacent ribs and wherein each said bridging portion is secured to said cap by a weld.

12. A valve comprising an elongated stem, a head on an end of said stem and defining an annular valve face thereon, an annular cap secured to an underside of said head, and a plurality of circumferentially disposed and radially extending ribs secured between said head and said cap to alternately define a plurality of inlet and outlet passageways therebetween adapted to circulate a coolant therethrough, said cap being secured to said head by an annular weld securing the peripheries of said cap and said head together and a plurality of circumferentially disposed welds, further disposed radially inwardly from said first mentioned weld, securing said ribs to said cap, each circumferentially adjacent pair of ribs have inner ends thereof secured together by a bridging portion and wherein one of said circumferentially disposed welds secures each bridging portion to said cap.

13. The valve of claim 12 wherein said stem is hollow and has a tube disposed centrally therein, a lower end of said tube secured to said head, said tube defining a first passage therein communicating with said inlet passageways and wherein a second passage is defined between said tube and said stem and communicates with said outlet passageways via a plurality of passages formed through said head.

14. The valve of claim 12 further comprising an annular chamber defined between said head and said cap, closely adjacent to said valve face, and wherein said chamber communicates with said inlet and outlet passageways.

15. The valve of claim 14 further comprising agitating means disposed in said chamber for vibrating therein during valve operation for stirring a liquid coolant in said chamber for improving heat transfer from said valve face to said coolant.

16. The valve of claim 15 wherein said agitating means constitutes an annular ring disposed in said chamber.

17. The valve of claim 16 wherein upper and lower surfaces of said ring are arcuate and flat, respectively, and at least substantially conform to surface portions formed on said head and said cap, respectively, defining said chamber.

18. A valve comprising an elongated stem, a head on an end of said stem and defining an annular valve face thereon, an annular cap secured to an underside of said head, a plurality of circumferentially disposed and radially extending ribs secured between said head and said cap to alternately define a plurality of inlet and outlet passageways therebetween adapted to circulate a coolant therethrough, an annular chamber defined between said head and said cap, closely adjacent to said valve face, and wherein said chamber communicates with said inlet and outlet passageways, and agitating means disposed in said chamber for vibrating therein during valve operation for stirring a liquid coolant in said chamber for improving heat transfer from said valve face to said coolant.

* * * * *